US010532557B2

(12) United States Patent
Wan

(10) Patent No.: US 10,532,557 B2
(45) Date of Patent: Jan. 14, 2020

(54) INK PUMPING

(71) Applicant: Hewlett-Packard Development Company, L.P., Houston, TX (US)

(72) Inventor: Sing Yan Wan, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/098,109

(22) PCT Filed: Jul. 22, 2016

(86) PCT No.: PCT/US2016/043714
§ 371 (c)(1),
(2) Date: Oct. 31, 2018

(87) PCT Pub. No.: WO2018/017135
PCT Pub. Date: Jan. 25, 2018

(65) Prior Publication Data

US 2019/0143672 A1 May 16, 2019

(51) Int. Cl.
*B41F 31/08* (2006.01)
*B41J 2/175* (2006.01)

(52) U.S. Cl.
CPC ..... *B41F 31/08* (2013.01); *B41J 2/17596* (2013.01)

(58) Field of Classification Search
CPC ..... B41J 2/17513; B41J 2/19; B41J 2/17566; B41J 2/17596
USPC ..... 347/84, 85, 93
See application file for complete search history.

(56) References Cited

U.S. PATENT DOCUMENTS

| | | | |
|---|---|---|---|
| 6,033,060 | A | 3/2000 | Minami |
| 6,116,726 | A | 9/2000 | Driggers |
| 6,824,139 | B2 | 11/2004 | Barinaga et al. |
| 7,033,007 | B2 | 4/2006 | Seethoo |
| 7,150,519 | B2 | 12/2006 | Kong et al. |

FOREIGN PATENT DOCUMENTS

| | | | |
|---|---|---|---|
| CN | 1239189 | A | 12/1999 |
| CN | 102985261 | A | 3/2013 |
| EP | 0639501 | A1 | 2/1995 |
| JP | S5670963 | | 6/1981 |
| JP | H1134355 | | 2/1999 |
| JP | 2005131989 | | 5/2005 |

*Primary Examiner* — An H Do
(74) *Attorney, Agent, or Firm* — HP Inc. Patent Department

(57) ABSTRACT

The present subject matter describes a system for pumping ink. In an example implementation, the system includes a piston assembly having a lower chamber and an upper chamber. The lower chamber has an inlet port to receive ink. The upper chamber has a passage to receive ink from the lower chamber and an outlet port to dispense ink. The upper chamber is enclosed by a bellow. An actuating member is engaged with the piston assembly. The actuating member is configured to linearly move the piston assembly. The piston assembly is configured to compress and relax the bellow by the linear movement to pump ink from the lower chamber to the upper chamber and from the upper chamber to the outlet port.

15 Claims, 4 Drawing Sheets

INK PUMPING

BACKGROUND

Imaging devices, such as printers are used to print on a print medium by ejecting ink through a nozzle on a print head of the imaging device. The ink for printing may be supplied from an ink reservoir. The imaging device includes a pump system for pumping ink from the ink reservoir to the print head.

BRIEF DESCRIPTION OF DRAWINGS

The following detailed description references the drawings, wherein.

DETAILED DESCRIPTION

Figure 1:
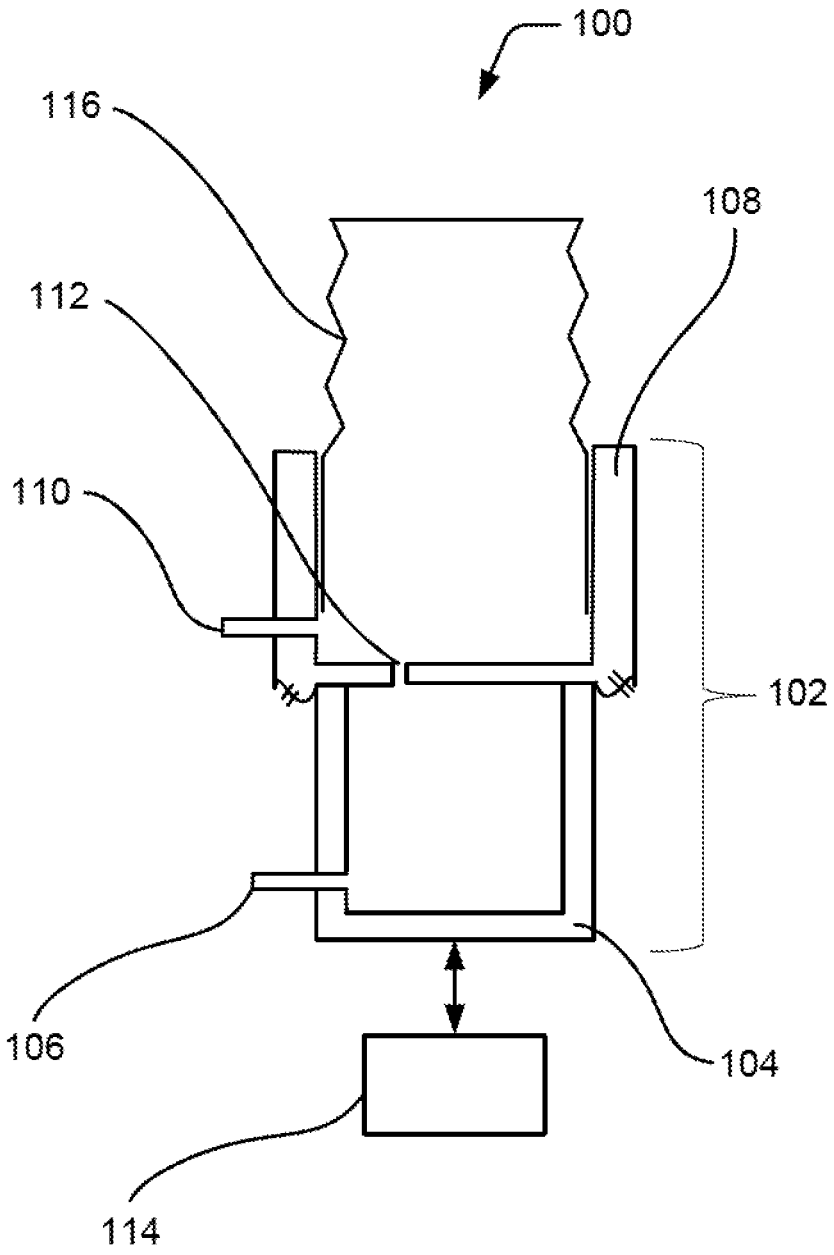
FIG. 1 illustrates a system for pumping ink in an imaging device, according to an example implementation of the present subject matter.

An imaging device prints on a medium by ejecting ink through a nozzle on a print head of the imaging device. Examples of an imaging device includes an ink-jet printer, a large format printer, an office/desk printer, a multi-function printer (MFP), a 3D printer, or the like. The print head receives a supply of ink from an ink reservoir which may be a replaceable cartridge, a fixed ink tank, or the like. Ink from the ink reservoir is pumped by a pump system of the imaging device to supply the ink to the print head. The pump system may be a peristaltic pump, a suction pump, a diaphragm pump, and the like.

When an imaging device is powered up after not being in use for a certain time, the imaging device may not function properly. This may be because of air trapped within the pump system of the imaging device. To remove the trapped air from within the pump system, the pump system has to be primed with ink during the first operation of the imaging device. An additional priming pump is generally installed in the imaging device for priming the pump system. In some imaging devices, an external suction pump may also be used for priming the pump system. The priming pump installed within the imaging device may make the imaging device bulky. Also, use of external suction pump may entail use of additional attachments/units for priming which may increase the complexity of the arrangement for priming the pump system. In addition, priming the pump system may be time consuming.

Further, in some imaging devices, ink may be pumped from the ink reservoir to the print head through a tube. With this arrangement, a differential pressure of up to 15 psi is maintained between the ink reservoir and the print head. In certain imaging devices, such as large format or grand format printers, because of large overall dimensions, the tube between the ink reservoir and the print head may be long. Thus, in such imaging devices the ink from the ink reservoir travels a long distance through the tube to reach the print head. This may lead to a pressure drop at the print head or may reduce the supply of ink to the print head resulting in poor printing quality. To obtain good quality printouts with large format or grand format printers the pump system may have to generate a differential pressure of more than 15 psi between the ink reservoir and the print head to flow adequate amount of ink to the print head. When the pump system is operated to attain a differential pressure of more than 15 psi the pump system may be overloaded and may thus fail.

The present subject matter describes systems for pumping ink in imaging devices, and imaging devices having such systems. The systems of the present subject matter, also referred to as ink pumping systems, enable self-priming, thereby eliminating the use of additional priming pumps in the imaging device which may make the imaging device more compact and may also reduce the complexity in priming the pump system of the imaging device. Further, the systems of the present subject matter may generate a high differential pressure between the ink reservoir and the print head and thus achieve a higher flow rate of ink to the print head. The systems and imaging devices of the present subject matter may operate at higher loads without failure and may have a higher efficiency.

In accordance with an example implementation of the present subject matter, the system includes a linearly movable piston assembly to pump ink from an ink reservoir to a print head of the imaging device. The piston assembly is positioned vertically within the imaging device and has two chambers or compartments. A lower chamber of the piston assembly receives ink through an inlet port coupled with an ink reservoir, such as an ink cartridge of the imaging device. An upper chamber of the piston assembly receives ink from the lower chamber though a passage. An outlet port coupled to the upper chamber may dispense/transfer the ink to the print head. The system also includes an actuating member coupled to the piston assembly. The actuating member linearly moves the piston assembly up and down in a reciprocating motion. The system further includes a bellow which encloses the upper chamber of the piston assembly. The bellow gets compressed and relaxed by the linear movement of the piston assembly. The compression and relaxation of the bellow enables ink to be pumped from the lower chamber to the upper chamber and from the upper chamber to the outlet port.

The system of the present subject matter, when powered up after a certain time period, generates a pressure that can pump a mixture of air and ink. Thus, air which may be trapped within the system may be pumped out until the system is saturated with ink and both the upper and lower chambers are filled with ink. In this manner, the system of the present subject matter may perform self-priming. The systems of the present subject matter may, therefore, eliminate the use of a separate priming pump in the imaging device or use of an external suction pump or priming unit. Thus, assembly and manufacture of the imaging devices with the systems of the present subject matter may be simpler and cost effective.

Also, the systems of the present subject matter may generate a high differential pressure between the ink reservoir and the print head. In some imaging devices, such as large format or grand format printers, such high differential pressures may ensure adequate supply of ink to the print head resulting in good quality printouts without overloading the ink pumping system.

The following detailed description refers to the accompanying drawings. Wherever possible, the same reference numbers are used in the drawings and the following description to refer to the same or similar parts. While several examples are described in the description, modifications, adaptations, and other implementations are possible. Accordingly, the following detailed description does not limit the disclosed examples. Instead, the proper scope of the disclosed examples may be defined by the appended claims.

FIG. 1 illustrates a system 100 for pumping ink in an imaging device, according to an example implementation of the present subject matter. The system 100 includes a piston assembly 102. The piston assembly 102 has two chambers. A lower chamber 104 of the piston assembly 102 is coupled to an inlet port 106. The inlet port 106 may be a port for entry of ink into the system 100. The inlet port 106 may interface with an ink reservoir (not shown) of the imaging device. With the system 100 installed in the imaging device, ink from the ink reservoir may pass into the lower chamber 104 through the inlet port 106. Similarly, an upper chamber 108 of the piston assembly 102 is coupled to an outlet port 110. The outlet port 110 may be a port from which ink exits the system 100. The outlet port 110 may interface with a print head (not shown) of the imaging device. Ink may be dispensed from the upper chamber 108 to the print head through the outlet port 110. The upper chamber 108 also has a passage 112, as shown in FIG. 1. The upper chamber 108 is fluidly coupled to the lower chamber 104 through the passage 112 so that ink pumped by the system 100 can flow from the lower chamber 104 to the upper chamber 108 through the passage 112.

The system 100 includes an actuating member 114 which engages with the piston assembly 102 to linearly move the piston assembly 102. The upper chamber 108 of the piston assembly 102 is enclosed by a bellow 116 so that the bellow 116 encompasses a storage volume of the upper chamber 108. The storage volume of the upper chamber 108 may refer to the maximum volume of fluid that can be stored inside the upper chamber 108. The actuating member 114 is operated to linearly move the piston assembly 102 downwards in a first stroke to relax the bellow 116 to pump ink from the lower chamber 104 to the upper chamber 108. In a second stroke, the actuating member 114 is operated to linearly move the piston assembly 102 upwards to compress the bellow 116 to pump ink from the upper chamber 108 to the outlet port 110. Thus, through reciprocating linear movements of the piston assembly 102 in the first and second strokes, the bellow 116 enclosing the upper chamber 108 is alternately compressed and relaxed. Due to compression and relaxation of the bellow 116, ink is pumped from the lower chamber 104 to the upper chamber 108 through the passage 112 and from the upper chamber 108 to the outlet port 110. From the outlet port 110 ink flows to the print head of the imaging device.

Figure 2:
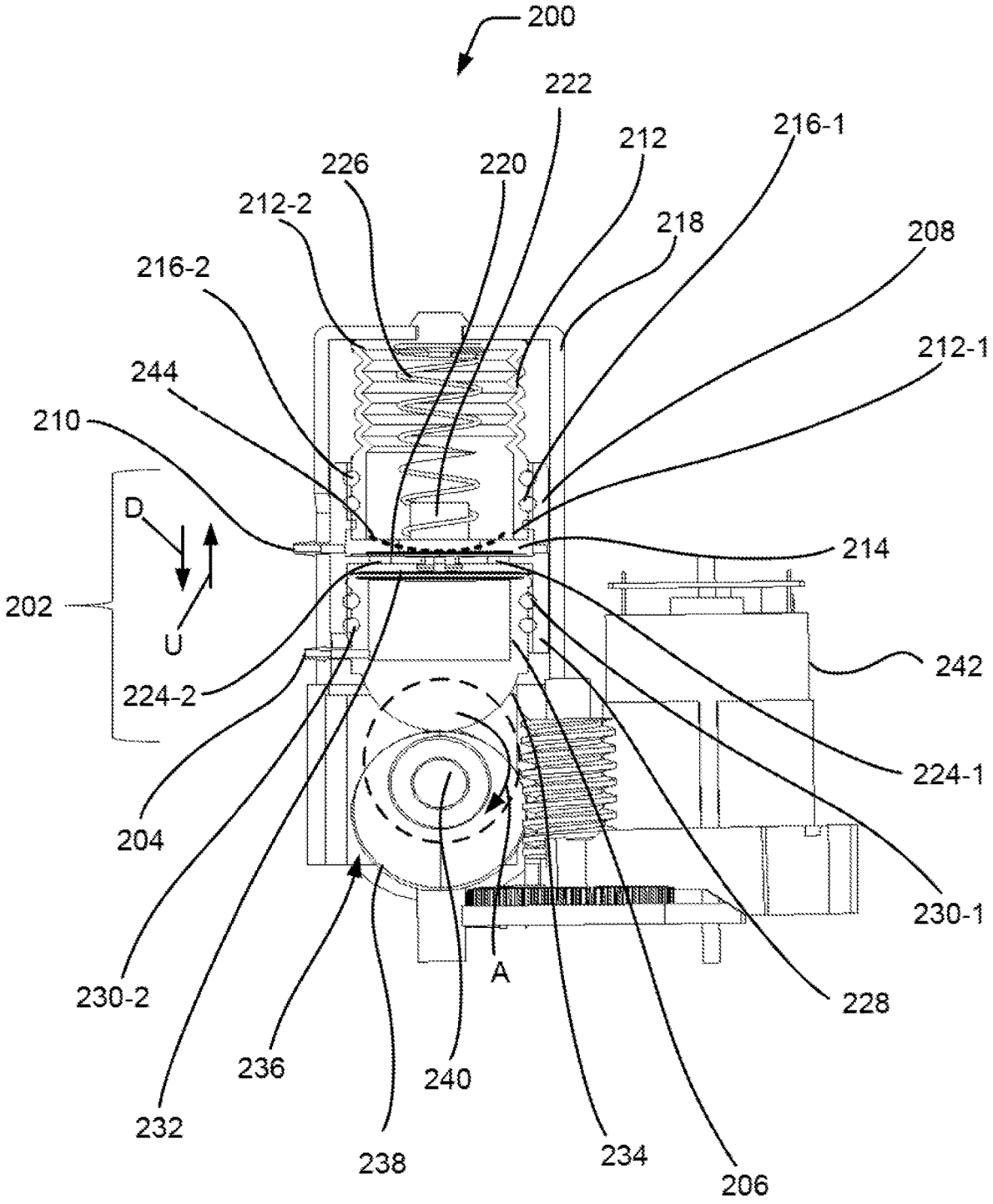
FIG. 2 illustrates a sectional view of a system for pumping ink in an imaging device, according to an example implementation of the present subject matter.

FIG. 2 illustrates a sectional view of a system 200 for pumping ink in an imaging device, according to an example implementation of the present subject matter. The system 200 includes a piston assembly 202. The piston assembly 202 is positioned vertically when the system 200 is installed in an imaging device.

The piston assembly 202 has an inlet port 204. One end of the inlet port 204 is connected to a lower chamber 206 of the piston assembly 202 and the other end of the inlet port 204 may be coupled to an ink reservoir (not shown) of the imaging device. The inlet port 204 may receive ink from the ink reservoir and transmit the ink to the lower chamber 206.

The piston assembly 202 has an upper chamber 208 and an outlet port 210. One end of the outlet port 210 is connected to the upper chamber 208 and the other end of the outlet port 210 may be coupled to a print head (not shown) of the imaging device. When the system 200 is operated, ink is pumped from the lower chamber 206 to the upper chamber 208 of the piston assembly 202 and from the upper chamber 208 to the print head of the imaging device.

The upper chamber 208 of the piston assembly 202 is a cylindrical compartment with an open top. The system 200 includes a bellow 212 which encloses the upper chamber 208 from the top so that a storage volume of the upper chamber 108 is encompassed by the bellow 212. The storage volume of the upper chamber 108 may refer to the maximum volume of fluid that may be stored inside the upper chamber 108. In an example implementation, the bellow 212 may be formed of flexible material, such as rubber or plastic. The bellow 212 has an open end 212-1 and a closed end 212-2. The open end 212-1 of the bellow 212 resides inside the upper chamber 208 thereby enclosing the upper chamber 208. The bellow 212 encloses the upper chamber 208 so that with linear movement of the piston assembly 202, the open end 212-1 of the bellow 212 linearly moves along with the piston assembly 202. As shown, ring gaskets 216-1 and 216-2 are introduced between interfacing surfaces of the bellow 212 and the upper chamber 208 to provide a tight fit between the bellow 212 and the upper chamber 208 and prevent slippage during movement of the piston assembly 202. The closed end 212-2 of the bellow 212 is fixed. The closed end 212-2 of the bellow 212 may be secured to a top surface of a cylindrical housing 218 which encloses the bellow 212 and the piston assembly 202.

Further, a flexible valve element 220 is positioned inside the upper chamber 208. The flexible valve element 220 rests on a surface at a bottom end 214 hereinafter referred as the bottom surface, of the upper chamber 208. The flexible valve element 220 may be held to the bottom surface by a valve retainer 222. The valve retainer 222 passes through a bore at the center of the flexible valve element 220 and bears studs (not shown). The studs of the valve retainer 222 may snap fit into an opening at the center of the bottom surface of the upper chamber 208 to retain the flexible valve element 220 on the bottom surface.

The flexible valve element 220 is movable between an open position and a closed position during linear movements of the piston assembly 202. In an example implementation, the linear movements of the piston assembly 202 occur in two strokes. During a first stroke, the piston assembly 202 moves downwards as indicated by arrow D and the flexible valve element 220 may bend to open the passages 224-1 and 224-2 in the bottom surface of the upper chamber 208 Thus, during the first stroke, the flexible valve element 220 remains in an open position, as depicted by a dashed curve 244 in FIG. 2, and facilitates flow of ink from the lower chamber 206 to the upper chamber 208 through passages 224-1 and 224-2. During a second stroke, the piston assembly 202 moves upwards as indicated by arrow U and the flexible valve element 220 rests on the bottom surface of the upper chamber 208 in the closed position to close the passages 224-1 and 224-2. Although, two passages 224-1 and 224-2 are shown in FIG. 2, the system 200 may have one passage or more than one passage.

It may be noted that the systems of the present subject matter use a single valve, such as the flexible valve element 220. Hence, the systems of the present subject matter may be cost-effective and less prone to failures in comparison to systems having pumps with multiple valves.

Further, a spring element 226 is positioned in the bellow 212. One end of the spring element 226 is coupled to the closed end 212-2 of the bellow 212 and the other end of the spring element 226 is coupled to the bottom end 214 of the upper chamber 208. As shown in FIG. 2, the other end of the spring element 226 is secured to the valve retainer 222. The spring element 224, when operates, dampens the compression and relaxation of the bellow 212.

Further, as shown in FIG. 2, a sleeve 228 projects from the bottom end 214 of the upper chamber 208. The sleeve 228 encloses the lower chamber 206 of the piston assembly 202. Ring gaskets 230-1 and 230-2 are introduced between interfacing surfaces of the sleeve 228 and the lower chamber 206 to provide a tight fit between the sleeve 228 and the lower chamber 206 and prevent slippage during linear movements of the piston assembly 202. Therefore, when the piston assembly 202 moves linearly up and down, the lower chamber 206 and the upper chamber 208 conjointly follow the linear up and down motions.

The piston assembly 202 may include a filter between the upper chamber and the lower chamber. In an example implementation, the filter may be a disk filter 232 positioned between the lower chamber 206 and the upper chamber 208 to filter ink pumped from the lower chamber 206 to the upper chamber 208. The disk filter 232 may rest on top of the lower chamber 206. The disk filter 232 may prevent dogging of print head nozzle by filtering out debris and ink solids which may remain suspended in the pumped ink.

In an example implementation, the lower chamber 206 has a curved bottom end 234, as shown in FIG. 2. The curved bottom end 234 of the lower chamber 206 is coupled to an actuating member 236 of the system 200. The actuating member 236 is engaged to linearly move the piston assembly 202 in a repetitive up-down motion. The actuating member 236 includes a cam element 238 mounted on a crankshaft 240. The lower chamber 206, in an example implementation, has a slot (not shown) at the curved bottom end 234. The cam element 238 may be positioned in the slot of the lower chamber 206 to couple with the lower chamber 206. In an example implementation, the crankshaft 240 may be a scalable crankshaft. The scalable crankshaft can be coupled to a scalable crankshaft of another ink pumping system identical to the system 200 to form an array of systems, as elaborated later in the description of FIG. 4. In an example implementation, the system 200 includes a motor 242 which operates to drive the scalable crankshaft.

In an example implementation, an imaging device, such as a desk printer, a large format printer, a MFP, and a 3D printer includes the system 200. The inlet port 204 may be connected to an ink reservoir and the outlet port 210 may be connected to a print head of the imaging device. Ink from the ink reservoir flows through the inlet port 204 into the lower chamber 206. During operation of the system 200, the crankshaft 240 is rotated by the motor 242. Rotation of the crankshaft 240 results in rotation of the cam element 238 mounted on the crankshaft 240.

With rotation of the cam element 238, the piston assembly 202 moves linearly within the cylindrical housing 218 to execute the first stroke and the second stroke alternately. In the first stroke, the cam element 238 moves from a top position, depicted by a dashed circle in FIG. 2, to a bottom position and the piston assembly 202 moves downwards, as indicated by arrow D. In the second stroke, the cam element 238 moves from the bottom position to the top position, depicted by the dashed circle, and the piston assembly 202 moves upwards, as indicated by arrow U.

The description hereinafter elaborates operation of the system 200 during the first stroke and the second stroke. Consider a case where the cam element 238 is at the top position, depicted by the dashed circle, and is about to move downwards to initiate the first stroke. At this position, the flexible valve element 220 rests on the bottom surface of the upper chamber 208, and the bellow 212 and the spring element 226 are compressed. The motor 242 rotates the crankshaft 240 in the direction indicated by arrow A. The cam element 238 rotates along with the crankshaft 240 and gradually moves from the top position, depicted by the dashed circle, towards the bottom position. This movement of the cam element 238 moves the piston assembly 202 downwards, as indicated by arrow D in FIG. 2. The downward movement of the piston assembly 202 gradually relaxes the bellow 212 and the spring element 226 which creates a partial vacuum inside the upper chamber 208. The partial vacuum results in a drop of fluid pressure in the upper chamber 208. The central region of the flexible valve element 220 moves downwards along with the upper chamber 208. The circumferential edge of the flexible valve element 220 remains lifted to attain an open position, depicted by a dashed curve 244, due to the pressure drop in the upper chamber 208. As the flexible valve element 220 bends to attain the open position, the passages 224-1 and 224-2 open up and ink from the lower chamber 206 is drawn up into the upper chamber 208 through the passages 224-1 and 224-2. As more and more ink flows inside the upper chamber 208, the level of ink in the upper chamber 208 gradually rises until the fluid pressure in the upper chamber 208 and the lower chamber 206 are balanced. As the fluid pressure in the two chambers gets balanced, the flexible valve element 220 moves and attains the closed position to shut off the passages 224-1 and 224-2. At the end of the first stroke, the flexible valve element 220 is at the closed position, the bellow 212 and the spring element 226 are relaxed, and the cam element 238 is at the bottom position.

The first stroke is reciprocated by the second stroke of the piston assembly 202. During the second stroke, the crankshaft 240 along with the cam element 238 rotates further in direction A and the cam element 238 moves from the bottom position towards the top position depicted by the dashed circle. This movement of the cam element 238 moves the piston assembly 202 upwards, indicated by arrow U, thereby compressing the bellow 212 and the spring element 226. The compression of the bellow 212 and the spring element 226 increases fluid (ink) pressure inside the upper chamber 208, thus retaining the flexible valve element 220 in the closed position to close the passages 224-1 and 224-2. As the passages 224-1 and 224-2 remain closed, due to the increased fluid pressure inside the upper chamber 208, ink is pushed out from the upper chamber 208 to the outlet port 210. From the outlet port 210 the ink is dispensed to the print head of the imaging device. Thus, the reciprocating first and second strokes, as described above, enable flow of ink from the lower chamber 206 to the upper chamber 208 and from the upper chamber 208 to the outlet port 210.

Figure 3:
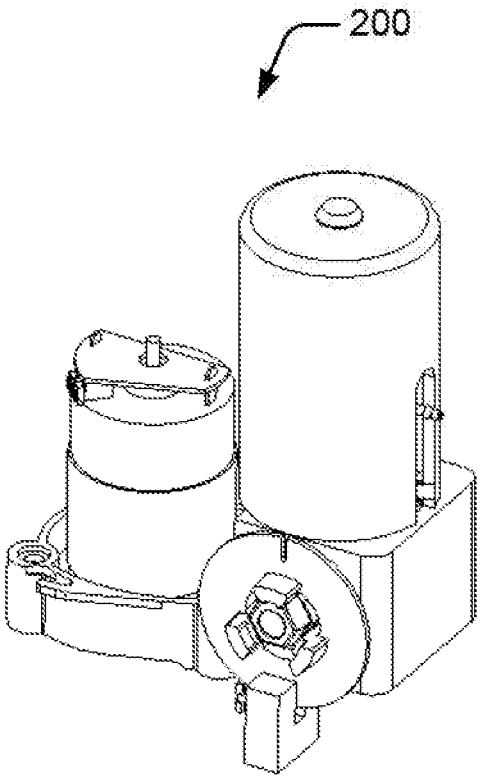
FIG. 3 illustrates a perspective view of the system of FIG. 2, according to an example implementation of the present subject matter.
Figure 4:
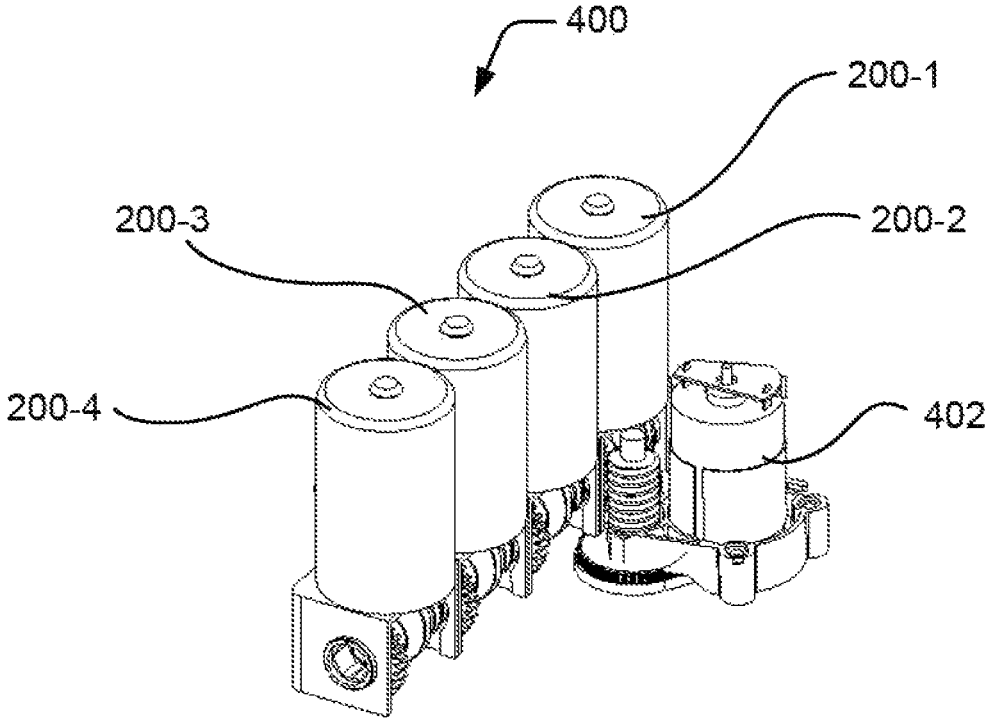
FIG. 4 illustrates an array of systems for pumping ink in an imaging device, according to an example implementation of the present subject matter.

FIG. 3 illustrates a perspective view of the system 200 of FIG. 2, according to an example implementation of the present subject matter. FIG. 4 illustrates an array of systems 400 for pumping ink in an imaging device, according to an example implementation of the present subject matter. The array of systems 400 may be formed by coupling a plurality of systems 200-1, 200-2, 200-3 and 200-4, each being identical to the system 200. Although FIG. 4 shows four systems in the array 400, however, the array 400 may be formed of two systems or more than two systems. In an example implementation, the crankshaft 240 of the system 200 may be a scalable crankshaft which can connect to a scalable crankshaft of another system identical to system 200 to form the array of systems 400. An actuating member may be mounted on respective scalable crankshafts of each of the systems 200-1 to 200-4, according to an example implementation. The actuating member may include a cam element, similar to the cam element 238 of FIG. 2, mounted on the scalable crankshaft. The scalable crankshafts and thus the systems 200-1 to 200-4 of the array 400 may be operated through a single motor 402. Each of the systems 200-1 to 200-4 in the array 400 can pump ink of different colors such as C (cyan), M (magenta), Y (yellow), and K (black) from an ink reservoir to a print head of an imaging device.

Although implementations for ink pumping systems for imaging devices are described in language specific to methods and/or structural features, it is to be understood that the present subject matter is not limited to the specific methods or features described. Rather, the methods and specific features are disclosed and explained as example implementations for ink pumping systems for imaging devices.

We claim:

1. A system comprising:

a piston assembly including:

a lower chamber having an inlet port to receive ink; and an upper chamber having a passage to receive ink from the lower chamber and having an outlet port to dispense ink;

a bellow enclosing the upper chamber; and an actuating member engaged with the piston assembly, the actuating member configured to linearly move the piston assembly and the piston assembly configured to compress and relax the bellow by the linear movement to pump ink from the lower chamber to the upper chamber and from the upper chamber to the outlet port.

2. The system as claimed in claim 1, wherein the piston assembly comprises a disk filter between the upper chamber and the lower chamber to filter ink.

3. The system as claimed in claim 1, wherein the actuating member comprises a cam element mounted on a crankshaft driven by a motor.

4. The system as claimed in claim 1, wherein the actuating member is configured to:

linearly move the piston assembly downwards in a first stroke to relax the bellow to pump ink from the lower chamber to the upper chamber; and linearly move the piston assembly upwards in a second stroke to compress the bellow to pump ink from the upper chamber to the outlet port.

5. The system as claimed in claim 4, wherein the piston assembly further comprises a flexible valve element positioned inside the upper chamber, the flexible valve element configured to open the passage during the first stroke and to close the passage during the second stroke.

6. The system as claimed in claim 1, further comprising a cylindrical housing enclosing the bellow and the piston assembly, the bellow having a closed end secured to a top surface of the cylindrical housing.

7. The system as claimed in claim 6, further comprising a spring element in the bellow and having one end coupled to the closed end of the bellow and other end coupled to a bottom end of the upper chamber, the spring element configured to dampen the compression of the bellow.

8. A system comprising:

a piston assembly including:

an inlet port to receive ink;

an outlet port to dispense ink;

a lower chamber coupled to the inlet port; and an upper chamber coupled to the outlet port and having a passage to receive ink from the lower chamber;

a bellow enclosing the upper chamber and having a closed top end;

an actuating member engaged with the piston assembly, the actuating member configured to move the piston assembly in a reciprocating motion and the piston assembly configured to compress and relax the bellow by the reciprocating motion to pump ink from the lower chamber to the upper chamber and from the upper chamber to the outlet port; and a spring element inside the bellow and having one end coupled to the closed top end of the bellow and other end coupled to a bottom end of the upper chamber, the spring element configured to dampen the compression of the bellow.

9. The system as claimed in claim 8, wherein the piston assembly further comprises a disk filter between the upper chamber and the lower chamber to filter ink.

10. The system as claimed in claim 8, wherein the actuating member comprises a cam element mounted on a crankshaft driven by a motor.

11. The system as claimed in claim 8, wherein the actuating member is configured to:

linearly move the piston assembly downwards in a first stroke to relax the bellow to pump ink from the lower chamber to the upper chamber; and linearly move the piston assembly upwards in a second stroke to compress the bellow to pump ink from the upper chamber to the outlet port.

12. The system as claimed in claim 11, wherein the piston assembly further comprises a flexible valve element positioned inside the upper chamber, the flexible valve element configured to open the passage during the first stroke and to close the passage during the second stroke.

13. An imaging device comprising:

a system for pumping ink in the imaging device, the system comprising:

a piston assembly including:

a lower chamber having an inlet port to receive ink; and an upper chamber having a passage to receive ink from the lower chamber and having an outlet port to dispense ink;

a bellow enclosing the upper chamber;

an actuating member engaged with the piston assembly, the actuating member configured to linearly move the piston assembly and the piston assembly configured to compress and relax the bellow by the linear movement to pump ink from the lower chamber to the upper chamber and from the upper chamber to the outlet port; and a scalable crankshaft driven by a motor, the actuating member mounted on the scalable crankshaft.

14. The imaging device as claimed in claim 13, wherein the piston assembly further comprises a disk filter between the upper chamber and the lower chamber to filter ink.

15. The imaging device as claimed in claim 13, wherein the actuating member comprises a cam element mounted on the scalable crankshaft.

* * * * *